United States Patent [19]

Hasegawa

[11] 4,094,344

[45] June 13, 1978

[54] APPARATUS FOR MENDING SURFACE IRREGULARITIES OF WOODEN PLATES

[75] Inventor: Katsuji Hasegawa, Nagoya, Japan

[73] Assignee: Meinan Machinery Works, Inc., Ohbu, Japan

[21] Appl. No.: 715,010

[22] Filed: Aug. 17, 1976

[51] Int. Cl.[2] ..... B65B 3/26

[52] U.S. Cl. ..... 141/125; 118/8; 141/181; 141/367; 144/2 R; 144/310 B; 156/94; 425/110

[58] Field of Search ..... 118/8, 410, 411, 415; 141/1, 100, 105, 114, 125, 129, 156–158, 177, 181, 187, 266, 280, 283, 284, 311 R, 351, 352, 367, 392; 144/2 R, 310 B, 309 R; 156/94; 425/13, 110

[56] References Cited

U.S. PATENT DOCUMENTS

| | | | |
|---|---|---|---|
| 2,336,421 | 12/1943 | Prue | 118/410 |
| 3,071,106 | 1/1963 | Burelbach et al. | 118/8 X |
| 3,362,379 | 1/1968 | Knudtson | 118/8 |

*Primary Examiner*—Richard E. Aegerter
*Assistant Examiner*—Frederick R. Schmidt
*Attorney, Agent, or Firm*—Blanchard, Flynn, Thiel, Boutell & Tanis

[57] ABSTRACT

An apparatus for mending surface irregularities of wooden plates such as those of plywood is provided. Recesses on a plate are automatically filled with putty by this apparatus. Putty is pressurized and the filling of the recesses therewith is controlled by a plurality of needles provided to detect these recesses. In this way, irregularities on a plate are effectively and automatically smoothed regardless of their shape or size.

9 Claims, 9 Drawing Figures

APPARATUS FOR MENDING SURFACE IRREGULARITIES OF WOODEN PLATES

BACKGROUND OF THE INVENTION

The present invention relates to an apparatus for mending irregularities on the surfaces of wooden plates and, more particularly, to an apparatus which smooths the surfaces of plywood by filling water-soluble putty, mainly composed of calcium carbide, in breaks and recesses on surfaces which include knotholes, splits, irregular surfaces due to rough cutting, and worm-eaten spots.

Mending of irregularities on the surfaces of plywood conventionally has relied solely on the unassisted eye of a worker for locating the undulations, then on his or her hands for filling them with putty. The smoothing work thus depending on the skills of a man is not fully acceptable in practice, however, in that recesses small enough to escape his or her sight remain unmended, and in that the manual work cannot fill the recesses with a desired efficiency while the evenness of the finish is limited.

SUMMARY OF THE INVENTION

It is therefore an object of the present invention to provide an apparatus for mending surface irregularities of a plate, which apparatus precludes the drawbacks inherent in the manual smoothing work and affords concurrent detection and filling of the recesses.

Another object of the present invention is to provide an apparatus of the type described which perfectly mends recesses, whatever their shape or size.

A further object of the present invention is to provide an apparatus of the type described which gives a smooth finish to the plate after its mending.

In order to achieve these objects, an apparatus embodying the present invention essentially comprises an apparatus for mending surface irregularities of a fed wooden plate comprising, a head transversely provided over said fed plate, having a plurality of putty passageways provided therein, with an outlet portion for said passageways, a pump for supplying pressurized putty to said outlet portion through said putty passageways, a plurality of slanting needles arranged close to each other for closing said outlet portion, resiliently provided to be movably so as to open the outlet portion when the end of the needle detects a recess on the surface of the fed plate, thereby falling down into the recess, and a spatula provided on the outfeed side of the head.

BRIEF DESCRIPTION OF THE DRAWINGS

The present invention will fully be understood from the following detailed description of the preferred embodiments with reference to accompanying drawings, in which.

DESCRIPTION

Figure 1:
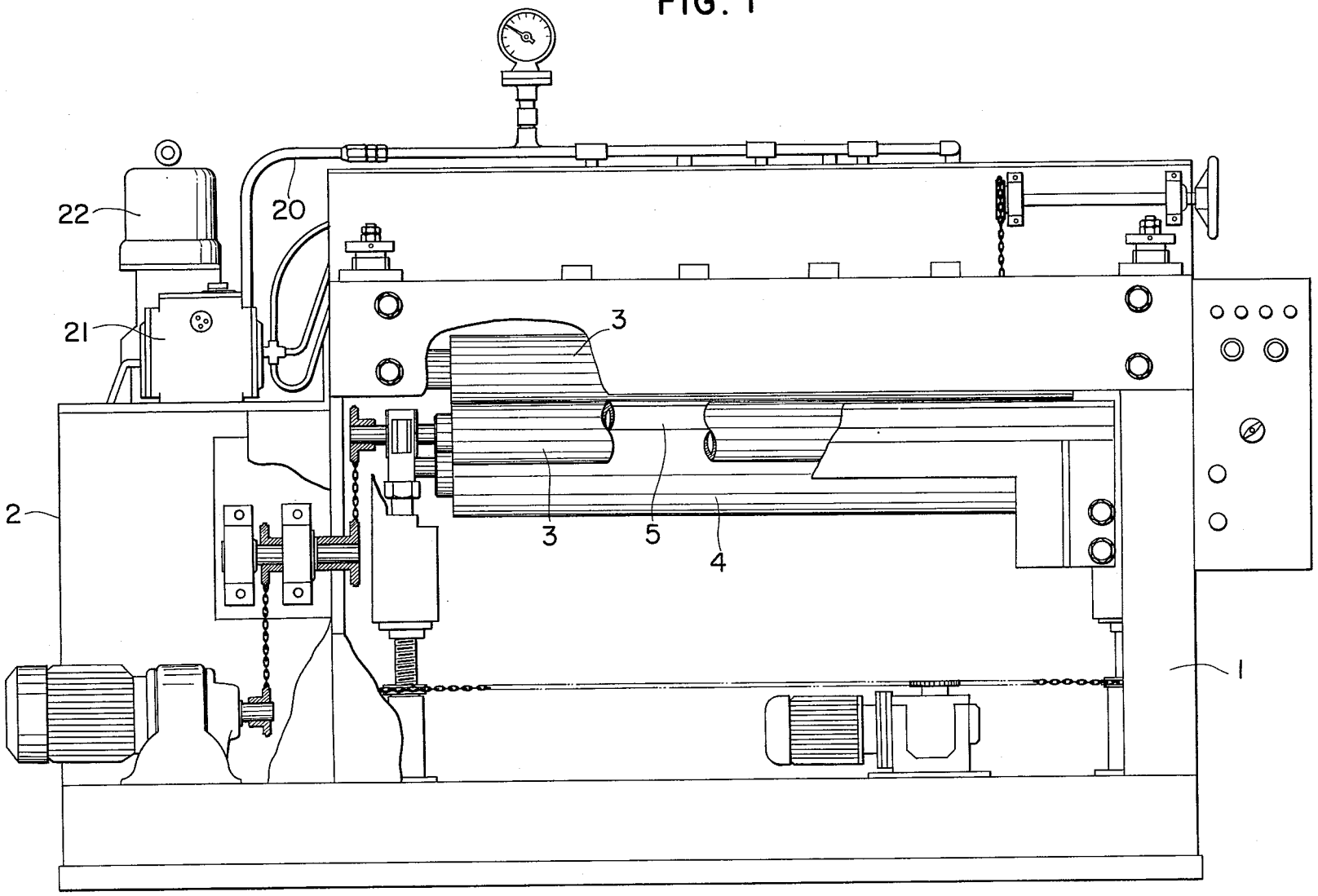
FIG. 1 is a partially cut away front view of a mending machine in which is installed an apparatus according to one embodiment of the present invention.
Figure 2:
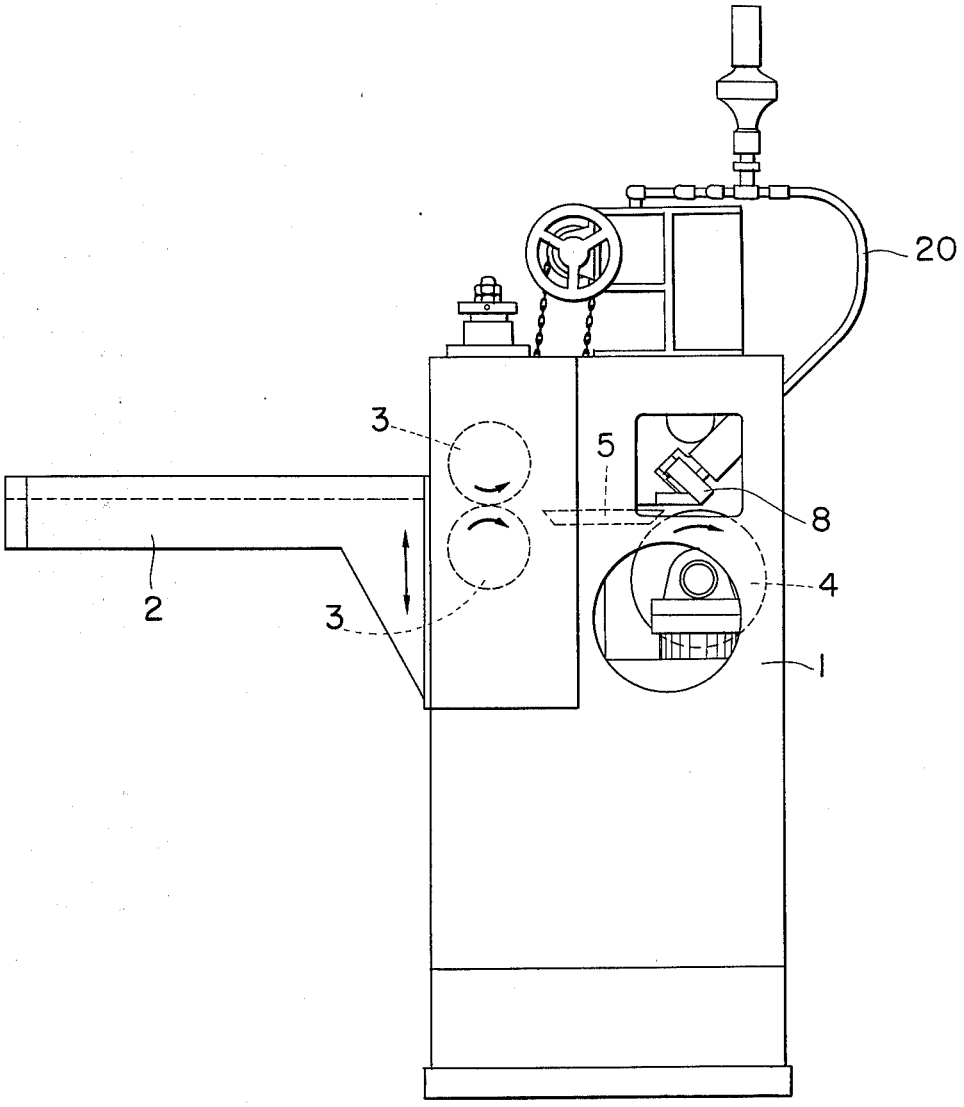
FIG. 2 is a side elevation of the mending machine shown in FIG. 1.
Figure 3:
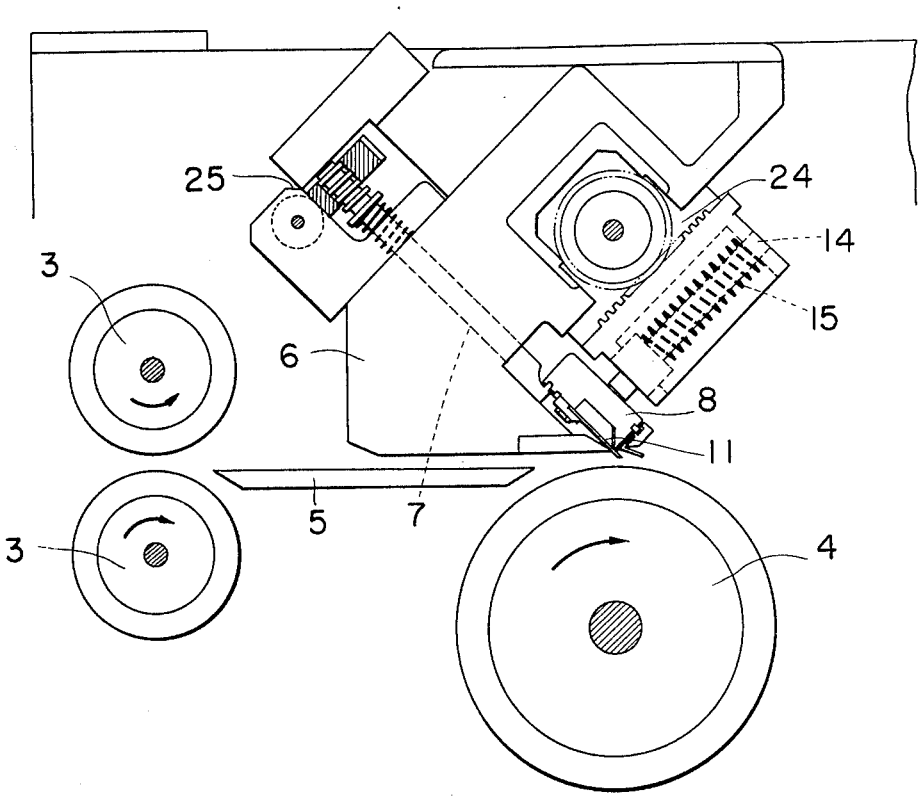
FIG. 3 schematically illustrates the overall arrangement of the apparatus according to one embodiment of the present invention.
Figure 4:
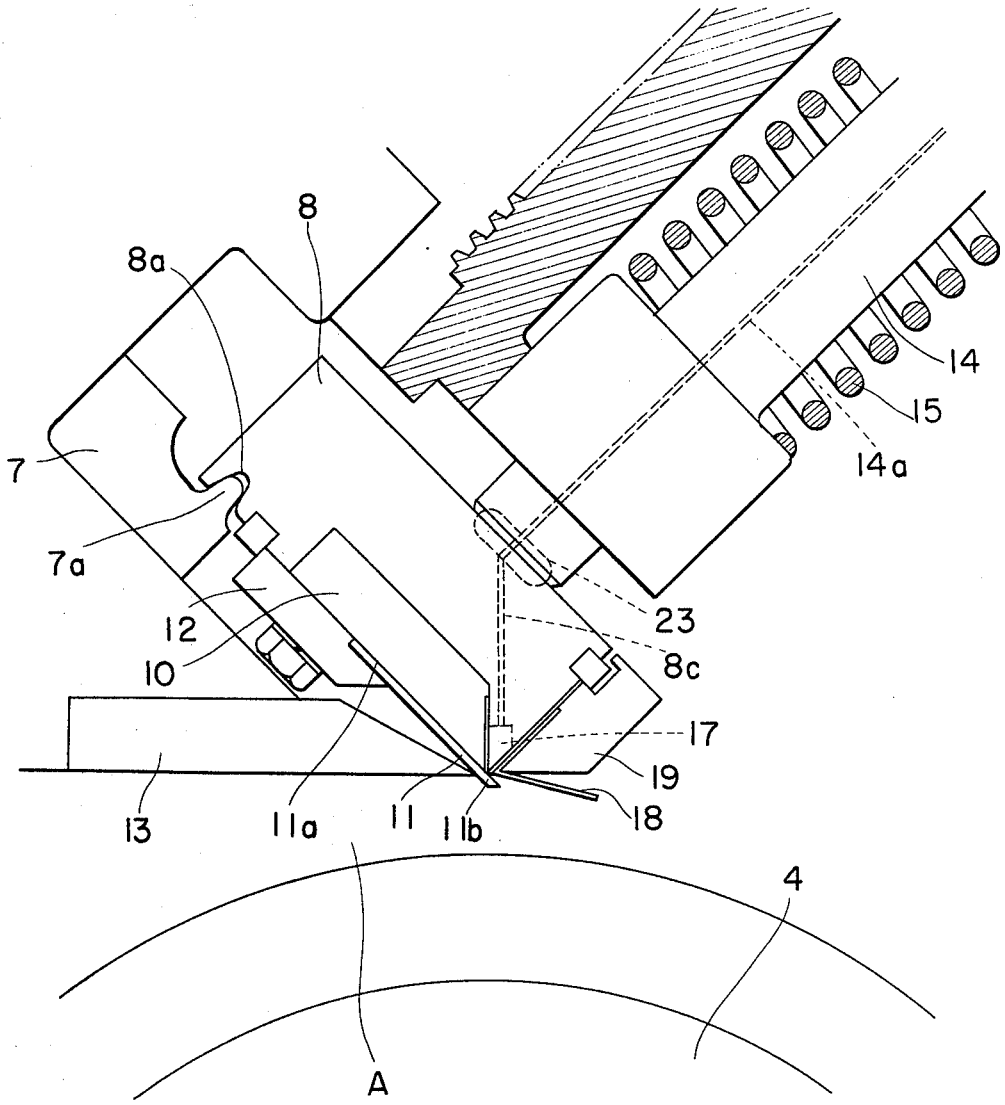
FIG. 4 is a fragmentary enlarged view of the arrangement shown in FIG. 3.
Figure 5:
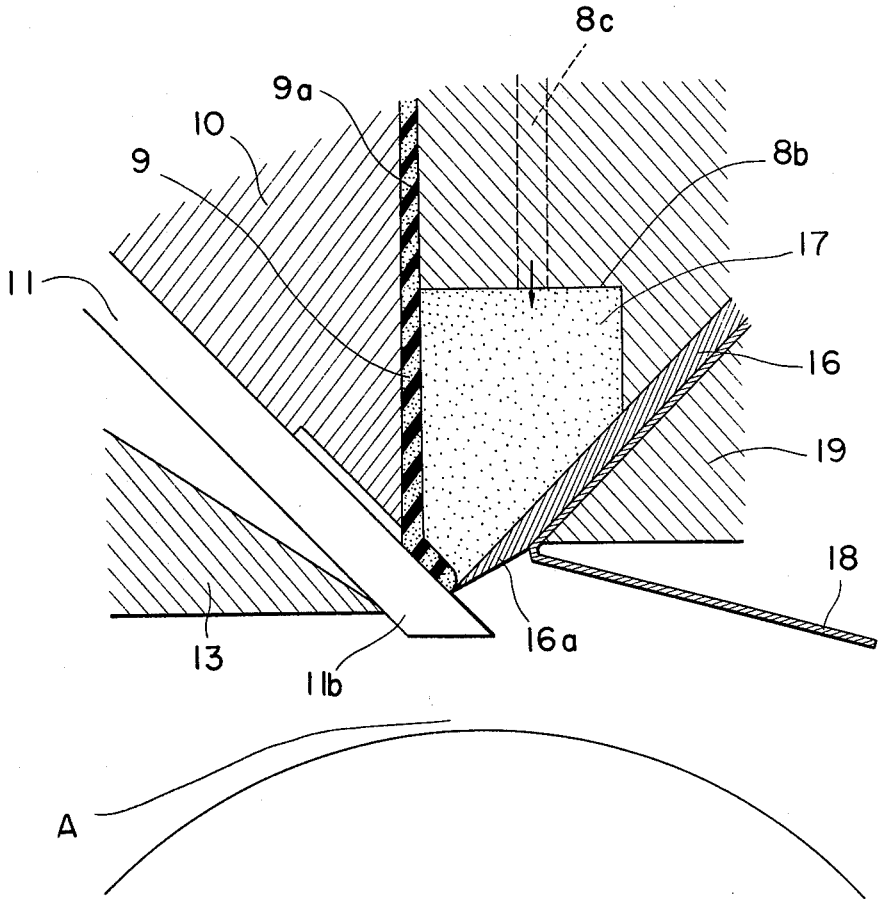
FIG. 5 is an enlarged, fragmentary section showing an essential part of the arrangement depicted in FIG. 4.
Figure 8:
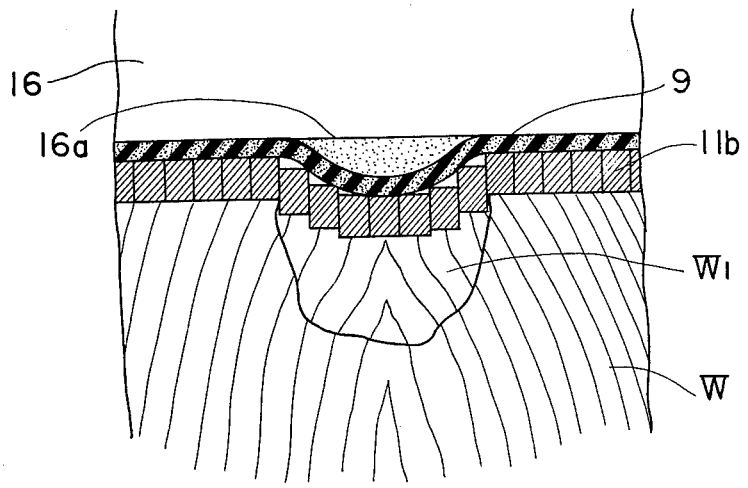
FIG. 8 is a section taken from line VIII-VIII of FIG. 7.

The preferred embodiment of the mending or smoothing apparatus according to the present invention will now be described with reference to the accompanying drawings. Referring to FIGS. 1 and 2, designated by reference numeral 1 is a frame on which a horizontal table 2 is mounted vertically, slidably relative to the frame. Denoted 3 are a pair of feed rollers adapted to feed a plate from table 2 to a backup roller 4. The outer peripheral surfaces of the feed rollers 3 and backup roller 4 are respectively covered with a resilient material, e.g. rubber, so that they may not damage the surfaces of the plate. An intermediate table 5 intervenes between the feed roller pair 3 and backup roller 4 while a beam 6 (FIG. 3) is positioned above table 5. As shown in FIG. 3, an adjusting rod 7 is slidably engaged with beam 6 in an annular position. Below said adjusting rod 7, a head 8 is transversely provided over a fed plate. At rod 7's lower end is a projection $7_a$ which is engaged in a recess $8_a$ formed in the head 8 as seen in FIG. 4 to permit head 8 to move a slight angular amount about the projection $7_a$. As shown in FIG. 5, groove $8_b$ extends along the lower end corner of head 8. A thin plate 9 of a resilient material such as rubber is sandwiched at its base portion $9_a$ between head 8 and a presser block 10. A series of elongate members or needles 11 are arranged close to each other (see FIG. 8) on the slanted lower surface of the presser block 10. One open side of the groove $8_b$ is closed by a plate 16 which at its lower end $16_a$ abuts against the upper surface of lower portions $11_b$ of each needle 11. The groove $8_b$, the resilient thin plate 9, and the plate 16 thus in cooperation define an outlet portion in the form of a chamber 17 for accommodating putty therein. Said thin plate 9 provides a resilient wall between the other open side of groove $8_b$ and the needles 11, thereby preventing the putty's leakage between adjacent needles. Each needle 11 has its base portion $11_a$ held by a presser plate 12 in fixed engagement with presser block 10. Said needles are arranged to close the outlet portion by means of said resilient plate 9 and the needles are resiliently movable. When the lower portion $11_b$ ofeach needle detects a recess on the surface of the fed plate, these lower portions $11_b$ fall down into the recess upon the detection thereof, thereby opening the outlet portion. The needles 11 are made of a resilient material and are respectively mounted so that their lower ends $11_b$ naturally tend to move downwardly away from presser block 10. The lower portions $11_b$ of the respective needles 11 are engaged with the leading end of a stop 13 mounted to the lower part of the beam 6 in order to limit the downward movement of the needles. The resilient abutment of the needles 11 against stop 13 is caused by a compression spring 15 acting through a pressure bar 14 which abuts against head 8. Although not shown, a plurality of pressure bars 14 are arranged lengthwise in relation to head 8. A levelling plate or spatula 18 of a resilient material is fixedly mounted together with plate 16 to head 8 by a presser plate 19 on the outfeed side of head 8. Head 8 is also provided with a plurality of passageways $8_c$ providing communication between chamber 17 and passageways $14_a$ extending through the respective pressure bars 14. Passageways $14_a$ in turn are connected to a heater 21 and a pump 22 via a conduit 20 (see FIGS. 1 and 2). Putty is pressurized by pump 22, usually at 30 kg/cm$^2$ or below. Heater 21 is adapted to heat the putty in order to promote smooth flow of the same. At least two of each of passageways $8_c$ and $14_a$ are formed to pass through head 8 and pressure bars 14, respectively, to define at least two fluid passages, one of which serves to feed putty into chamber 17, the other discharging the putty out of chamber 17. With this arrangement, the heated putty is circulated through chamber 17 under pressure. An annular packing member 23 is employed to prevent the putty fed under pressure from leaking from passageways $8_c$ and $14_a$ at the interface of head 8 and pressure bar 14.

A pinion and rack mechanism 24 is employed to facilitate ready mounting and demounting of head 8 by retracting and advancing pressure bar 14. The level to which ends $11_b$ project downwardly beyond the lower end of stop 13 is adjustable by sliding the adjusting rod 7 by means of a worm gear and worm wheel mechanism 25.

Figure 6:
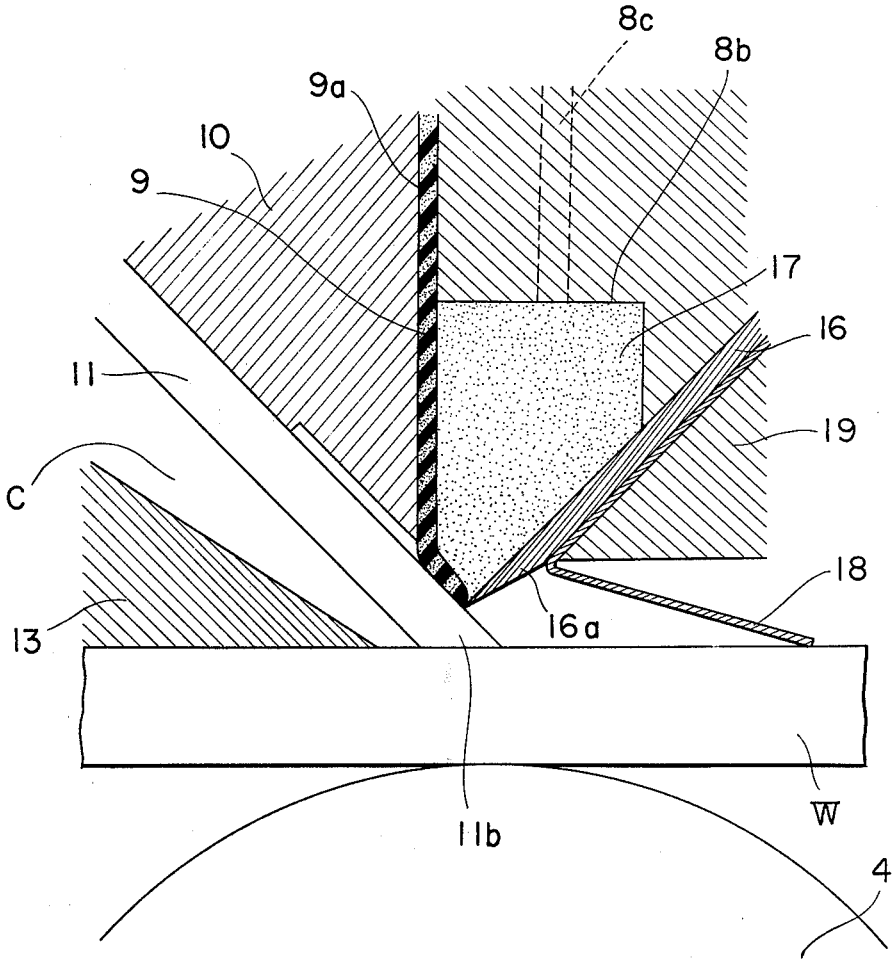
FIG. 6 shows the apparatus of the invention with a plate fed thereto.

The mending apparatus thus constructed according to the present invention operates as follows. A plate W loaded on the table 2 is advanced by the feed roller pair 3 into a path or gap A between backup roller 4 and stop 13. Plate W thus travels while being pressed against the lower end of stop 13 by backup roller 4 so that lower portions $11_b$ of the respective needles 11 projecting downward below the lower end of stop 13 as shown in FIG. 5 are subject to an upward force exerted by the plate W. Consequently, head 8 is angularly moved counterclockwise against the action of the springs 15 about the rod projection $7_a$ with which its recess $8_a$ is engaged until the ends of the needles 11 are raised sufficiently to become flush with the bottom of stop 13 as illustrated in FIG. 6, whereby a small gap C is produced between stop 13 and lower portions $11_b$ of the needles. In case the surface of plate W bears no irregularities, each of the needles 11 remain in the position illustrated in FIG. 6, being held in this position by plate W, with chamber 17 hermetically closed by plates 9 and 16.

Figure 7:
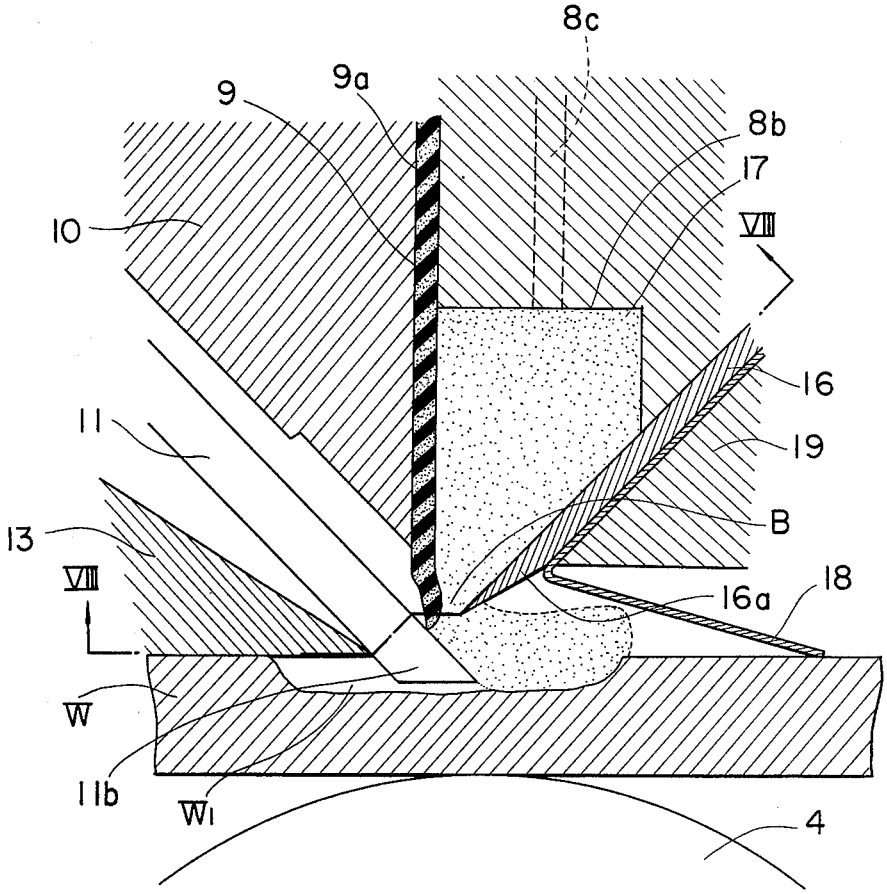
FIG. 7 shows the apparatus which is filling putty in a recess of the plate.

In the situation described above, plate W is resiliently pressing head 8 upward through the bottom halves of the respective needles 11, and the lower portions $11_b$ of needles 11 remain in engagement with the presser block 10. The lower portions $11_b$ of the needles, when they come upon a recess $W_1$ on the surface of plate W, are resiliently urged downwardly into the recess as depicted in FIG. 7. The needles 11 which have not fallen into the recess $W_1$, however, remain in the position illustrated in FIG. 6 as apparent from FIG. 8 and, hence, head 8 still remains in its angular position to which it has been moved. The ends of the needles thus resiliently pressed into recess $W_1$ are disengaged from the lower end $16_a$ of plate 16 to produce an opening B therebetween. As a result, the putty deposited in chamber 17 flows out of the chamber through opening B to fill up recess $W_1$. The putty, while filling recess $W_a$, will slightly swell beyond the horizontal surface of plate W. Thus, the protuberant part of the putty is leveled by the spatula 18 so that the surface of the putty filling the recess becomes desirably flush with that of the plate W.

Figure 9:
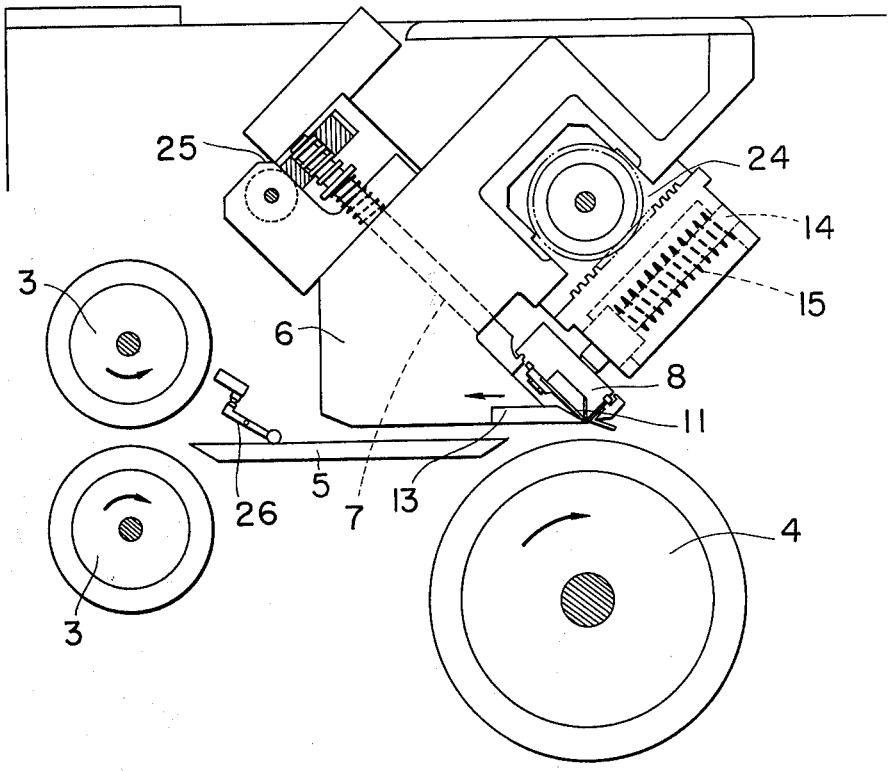
FIG. 9 illustrates another embodiment of the device according to the present invention.

In the embodiment described so far, the lower portions $11_b$ of needles 11 project downward below the lower end of stop 13 as depicted in FIG. 5 when plate W is not fed into the gap A. However, the ends of needles 11 may be arranged to be flush with the bottom of stop 13 as shown in FIG. 9. In this case, however, stop 13 must be adapted to retreat in the arrow-marked direction the moment plate W reaches the ends of needles 11, so that the lower portions $11_b$ may fall down into recesses, if any, on the surface of the plate W. For this arrangement, the provision of a timer-equipped sensor 26, for transmitting a signal to actuate the stop 13, on the infeed side of needles 11 may be in order.

It can be seen, therefore, that irregularities on the surface of plywood can be mended by detecting recesses on its surface and filling them simultaneously with putty.

It can further be seen that the recesses are perfectly mended, whatever their shape or size.

It can still further be seen that a smooth finish is given to the plate after its mending.

It is to be understood that while two preferred embodiments of the invention are shown herein, these embodiments are only for exemplary use and are not to be construed in a limiting sense. Other similar arrangements and modifications will occur to those skilled in the art and may be incorporated without departing from the spirit and scope of the invention.

What is claimed is:

1. An apparatus for mending surface irregularities of a wooden plate which is fed past the apparatus in a selected direction along a predetermined path, said apparatus comprising:

support means;

head means mounted on said support means in an angled relationship with respect to said path, and cooperating means between said head and support means for permitting slight angular movement of said head means, said head means being located over the path of said wooden plate and having a putty outlet formed in the lower portion thereof, said head means also having passageway means provided therein for communication with said outlet;

supply means connected to said passageway means for supplying pressurized putty to said outlet;

a plurality of elongated needles positioned closely adjacent each other, said needles being disposed in a slanted relationship with respect to the wooden plate and having the upper portions thereof mounted on the lower portion of said head means, the lower portions of said needles being positioned adjacent said outlet and disposed for engagement with said wooden plate as it moves along said path whereby said wooden plate holds said lower portions of the needles in an upper position wherein they close said outlet, means causing said lower portions of the needles to be normally resiliently urged downwardly away from said head means and away from said outlet whereby they will move downwardly into any recesses or other surface irregularities in the wooden plate so as to at least partially open said outlet, the lower portions of said needles extending transversely above the path of said wooden plate;

pressing means acting against said head means for causing pivotal movement of said head means in a direction causing said lower portions of the needles to be moved downwardly toward the path; and stop means positioned for engagement with the needles for limiting the downward movement of the lower portions of said needles away from said head means.

2. An apparatus according to claim 1, wherein the lower portions of said needles normally project downwardly below said stop means when said needles are not engaged with a wooden plate, said stop means maintaining the lower portions of the needles against the lower portion of said head means when in this condition of operation.

3. An apparatus acccording to claim 1, wherein the lower end portions of said needles are flush with the bottom of said stop means, at least when the needles are disposed in engagement with a wooden plate.

4. An apparatus according to claim 3, including means for moving the stop means away from the head means when a wooden plate approaches and contacts the lower end portions of the needles so as to permit the lower end portions of said needles to be urged downwardly upon sensing a recess or irregularity in the surface of the wooden plate.

5. An apparatus according the claim 1, wherein a thin resilient plate-like member is positioned between the needles and the outlet to prevent putty from leaking from the outlet when the lower portions of the needles are held against the lower portion of said head means.

6. An apparatus according to claim 1, including spatula means provided adjacent said head means and disposed substantially along said path at a location which is disposed downstream of said needles, whereby said spatula means smooths and levels the putty which is deposited in the surface irregularities.

7. An apparatus according to claim 1, wherein said means causing said lower portions of the needles to be resiliently urged downwardly away from said head means comprising forming said needles as elongated resiliently deflectable elements which are mounted on said head means so that the lower portions of said elements are normally resiliently urged downwardly away from said head means.

8. An apparatus according to claim 1, wherein said outlet extends across the width of said head means in perpendicular relationship to the selected direction of movement of said wooden plate, said head means having a movable seal member mounted thereon and positioned for overlapping said outlet for closing same, and said plurality of needles being mounted on said head means and disposed with the lower portions of said needles overlapping said resilient seal member for maintaining same in a position wherein it closes said outlet, and said plurality of needles being disposed in a row which extends transversely of said path with the individual needles in said row being disposed closely adjacent one another in side-by-side relationship.

9. An apparatus for mending surface irregularities of a wooden plate which is fed past the apparatus in a selected direction along a predetermined path, said apparatus comprising:

head means having an elongated outlet opening formed therein and positioned directly above said path, said outlet opening extending transversely of said path for permitting discharge of putty into surface irregularities on a wooden plate which moves along said path, passage means communicating with said outlet opening for supplying pressurized putty thereto, a flexible sealing member positioned adjacent said head means and disposed for normally closing said outlet opening for preventing discharge of putty therefrom, sensing means for sensing an irregularlity on the surface of a wooden plate and for permitting selected portions of said sealing member to be moved away from said outlet opening so that putty may flow therethrough solely in the vicinity of said surface irregularities, said sensing means including a plurality of resilient elongated needles which are mounted on said head means within an elongated row which extends substantially parallel with the elongated direction of said outlet opening, the individual needles within said row being disposed closely adjacent one another in side-by-side relationship, said needles having one end thereof connected to said head means and the other end of said needles being positionable closely adjacent said head means and coacting with said sealing member for holding said sealing member in overlapping relationship with said outlet opening so as to close same, said needles having the lower portions thereof normally resiliently urged away from said head means so as to permit said flexible sealing element to uncover said outlet opening, stop means coacting with the lower portions of said needles for holding same in a position adjacent said head means so that the sealing member is disposed so as to sealingly close said outlet opening when the needles are not engaged with a wooden plate, and means coacting between said head means and said stop means for permitting relative movement therebetween in response to said wooden plate being moved along said path for permitting said stop means and the lower portions of said needles to be relatively moved away from one another, whereby said needles are maintained against said head means by said wooden plate so that only selected needles will be resiliently urged away from said head means so as to selectively open only portions of said outlet opening in response to the sensing of irregularities in the surface of said wooden plate.

* * * * *